US006921990B1

(12) United States Patent
Higgins

(10) Patent No.: US 6,921,990 B1
(45) Date of Patent: Jul. 26, 2005

(54) ELECTRONIC STATUS MONITORING SYSTEM FOR SECURITY CONTAINERS

(75) Inventor: Robert C. Higgins, Tiverton, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 88 days.

(21) Appl. No.: 10/624,171

(22) Filed: Jul. 21, 2003

(51) Int. Cl.[7] ..... G08B 13/00; G08B 23/00; H01H 9/00; E05C 9/00; H01R 13/44

(52) U.S. Cl. ..... 307/328; 109/38; 312/216; 340/500; 340/652; 340/687; 439/133

(58) Field of Search ..... 200/42.01–43.22, 200/52 R, 334; 335/205; 439/133, 439; 307/326–328; 109/35–44; 340/500, 652, 653, 686.1, 687; 312/216–221, 352

(56) References Cited

U.S. PATENT DOCUMENTS 4,105,885 A * 8/1978 Orenstein ..... 200/52 R
4,317,969 A * 3/1982 Riegler et al. ..... 335/205 X
4,598,964 A * 7/1986 Frink et al. ..... 439/133

* cited by examiner

*Primary Examiner*—James R. Scott
(74) *Attorney, Agent, or Firm*—Michael F. Oglo; James M. Kasischke; Jean-Paul Nasser

(57) ABSTRACT

An electronic monitoring system is disclosed for detecting the open and closed conditions of containers or cabinets containing confidential or classified information. The electronic monitoring system includes a current sensor that detects the presence of a locking bar secured to the containers. A current sensor located on each cabinet operatively cooperates with the transmitter that transmits a signal to a central location, which provides an indicator of the secured or non-secured condition of the container.

20 Claims, 5 Drawing Sheets

ELECTRONIC STATUS MONITORING SYSTEM FOR SECURITY CONTAINERS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to an electronic monitoring system, and more specifically, to a system for monitoring the removal and attachment of a fastener, such as a locking bar, associated with a security container or cabinet, wherein a signal which is unique for each particular cabinet is sent to a centralized monitoring station which keeps track of the fastener status of all cabinets that are being used no matter where they are located.

(2) Description of the Prior Art

Containers and cabinets housing confidential, classified or even highly classified material commonly employ safety mechanisms that guard against unwanted exposure of the material being housed to adverse contingencies. A common safety mechanism is a fastener, which may be a locking bar, that is arranged with a locking device so that when the bar is attached to the cabinet the drawers being lodged in the cabinets are prevented from moving outward, thereby, making safe to unwanted exposure of the materials therein.

The locking bars serve well their intended purpose, but the actual use thereof suffers practical drawbacks. More particularly, sometimes the locking bar is removed to allow the drawers to be opened and the contents thereof revealed to an authorized person, but sometimes the authorized persons forget to reattach the locking bar to the cabinet, thereby exposing the contents of the cabinet to adverse contingencies. Further, the cabinets are sometimes placed at remote locations preventing them from being viewed during conduct of normal activities, thereby, leaving the contents of cabinets susceptible to uncontrolled viewing. Normally, monitoring these remote locations undesirably involves time-consuming tasks of individuals that sometimes suffer from human error drawbacks. It is desired that a monitoring system be provided to determine whether the safety mechanism is in place so as to secure the container or cabinet no matter where the container or cabinet is located.

SUMMARY OF THE INVENTION

It is an object of the present invention to provide for a system for monitoring the status of containers or cabinets housing confidential, classified or highly classified materials.

It is a further object of the present invention to provide an electrical status monitoring system that determines the presence or absence of the security mechanism that ensures the security of a container or cabinet, even if the container or cabinet is located at a remote location.

It is a further object of the present invention to display the security status information of a secured container or cabinet at a central location.

It is a further object of the present invention to provide for an electronic system for monitoring a large number of containers or cabinets containing proprietary or classified documentation located at remote facilities utilized for military or commercial applications.

It is a further object of the present invention to provide for a system for monitoring the secured condition of containers or cabinets containing secured information and which does not suffer high labor intensity cost, and human error drawbacks of prior art systems.

In accordance with one aspect, an electronic monitor is provided for detecting the presence and absence of a fastener that secures a cabinet with the presence thereof preventing the opening of one or more drawers being housed in the cabinet. The electronic monitor comprises; (a) a first electrode fixed at a predetermined location of the fastener; and (b) a current sensing network having second and third electrodes located in the cabinet in a predetermined manner so that the first electrode contacts both the second and third electrodes when the fastener secures the cabinet. The current sensing network generates current flow and an output signal when the first, second and third electrodes are in contact and which is representative that the fastener is secured. The electronic monitor further comprises a (c) transmitter connected to the output of the current sensing network and generates a predetermined signal of a selected communication system upon detection of a change in current flow.

In accordance with another aspect, an electronic monitoring system is provided for detecting and displaying at a central location the presence and absence of one or more fasteners that respectively secure one or more cabinets with the presence thereof preventing the opening of one or more drawers being housed in each of the one or more cabinets. The electronic monitoring system comprises; (a) a first electrode fixed at a predetermined location on each of the respective fasteners; and (b) a current sensing network for each of the one or more cabinets and having second and third electrodes located on a respective cabinet in a predetermined manner so that the first electrode of a respective fastener contacts both the second and third electrodes of its respective cabinet when the respective fastener secures the respective cabinet. The current sensing network generates current flow and an output signal when the first, second and third electrodes are in contact and which is representative that the respective fastener is secured. The electronic monitoring system further comprises a (c) transmitter located on each of the cabinets and connected to the output of a respective current sensing network and generating predetermined signals of a communication link upon detection of a change in said current flow. Each of the transmitters generates predetermined signals which are different from each other. The electronic monitoring system further comprises a (d) receiver located at the central location and accepting and recognizing all of the different predetermined signals of all of the transmitters and generating respective output signals representative of the presence and absence of respective fasteners attached to respective cabinets.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numbers refer to like parts and in which:

DESCRIPTION OF THE PREFERRED EMBODIMENTS

Figure 1:
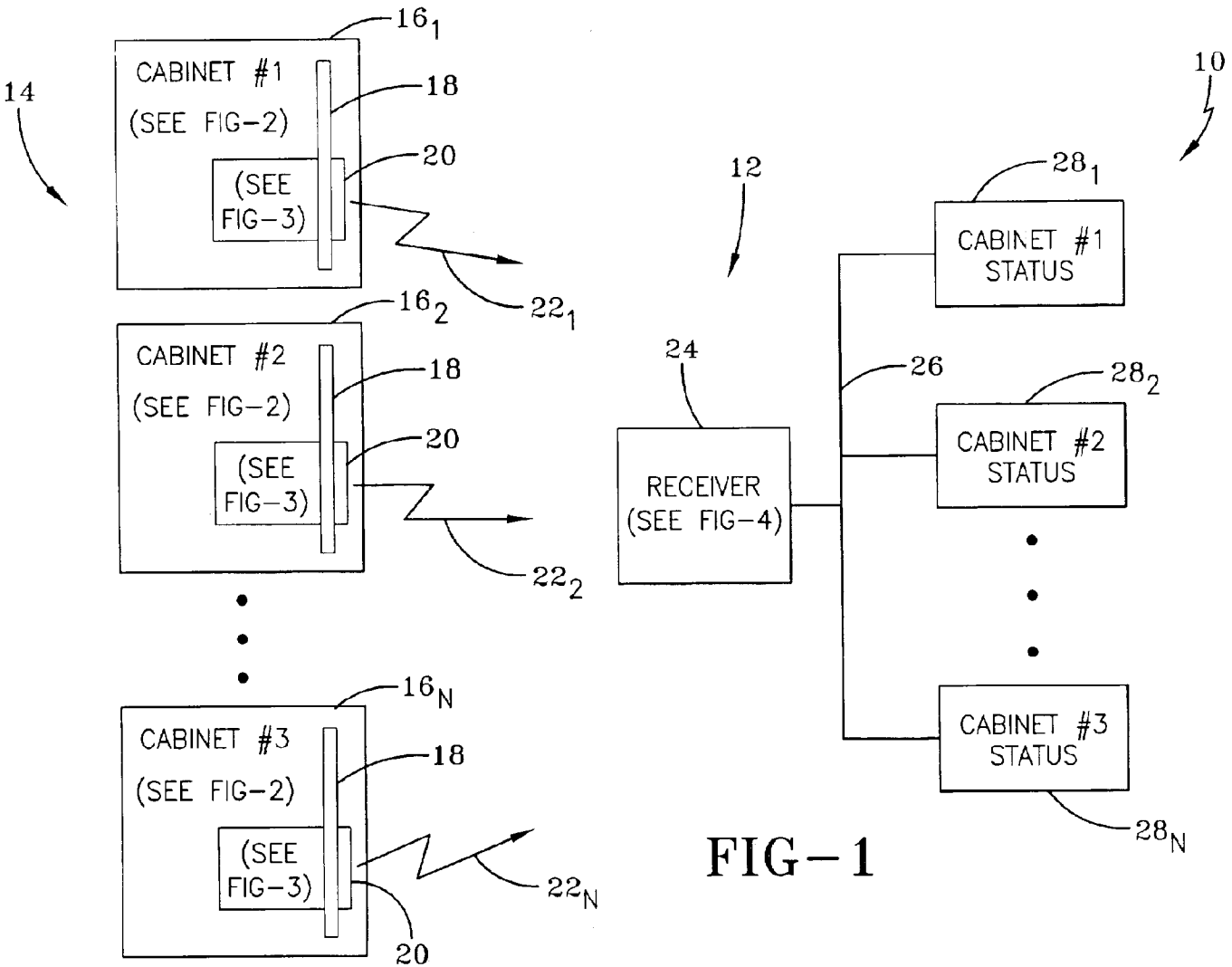
FIG. 1 is a block diagram of the electronic status monitoring system of the present invention.

With reference to the drawings, FIG. 1 illustrates an electronic monitoring system 10 for detecting and displaying at a central location 12 the presence and absence of fastener devices including bars, locks and clamps located at a remote location 14 and respectively secured to one or more cabinets $\mathbf{16}_1$, $\mathbf{16}_2$ . . . $\mathbf{16}_n$, with the presence thereof preventing the opening of one or more drawers being housed in each of the one or more cabinets $\mathbf{16}_1$, $\mathbf{16}_2$, $\mathbf{16}_N$.

More particularly, each of the cabinets $\mathbf{16}_1$, $\mathbf{16}_2$ . . . $\mathbf{16}_N$ has a fastener 18, which in one form may be a locking bar, that secures the contents of a respective cabinet 16 from adverse contingencies and electronics 20 that respectively generate output signals $\mathbf{22}_1$, $\mathbf{22}_1$ . . . $\mathbf{22}_N$ which represent the presence and absence of a respective fastener 18 securing a respective cabinet 16.

Each of the output signals $\mathbf{22}_1$, $\mathbf{22}_1$ . . . $\mathbf{22}_N$ is accepted and recognized by a receiver 24 at the central location 12. The receiver 24 generates respective output signals of the received signals which are representative of the presence and absence of the respective fastener 18 securing the respective cabinet 16 and which are displayed, via signal path 26 to respective indicators $\mathbf{28}_1$, $\mathbf{28}_2$ . . . $\mathbf{28}_N$ to be further discussed hereinafter with reference to FIG. 4.

The purpose of the electronic monitoring system 10 is to determine whether the fastener, such as a vertical locking bar 18 for a security container or cabinet 16 is attached or unattached with the attachment thereof preventing the contents of cabinets 16 from being viewed. The status of the attached/unattached locking bar 18 is sent back to a central monitor, more particularly, to receiver 24, which displays the status information. This configuration shown in FIG. 1 may be used in a military or commercial building to monitor the status of a large number of cabinets 16 containing proprietary or classified documentation no matter where the cabinets 16 are located. In the military where classified information is stored in security containers, such as cabinets $\mathbf{16}_1$ . . . $\mathbf{16}_N$ or in the commercial environment where proprietary information may be guarded, as well as secured, there is a need for a centralized monitoring system, such as the electronic monitoring system 10 of the present invention. Further details of the cabinets $\mathbf{16}_1$, $\mathbf{16}_2$ . . . $\mathbf{16}_N$ and fasteners $\mathbf{18}_1$, $\mathbf{18}_2$ . . . $\mathbf{18}_N$ may be further described with reference to FIG. 2.

Figure 2:
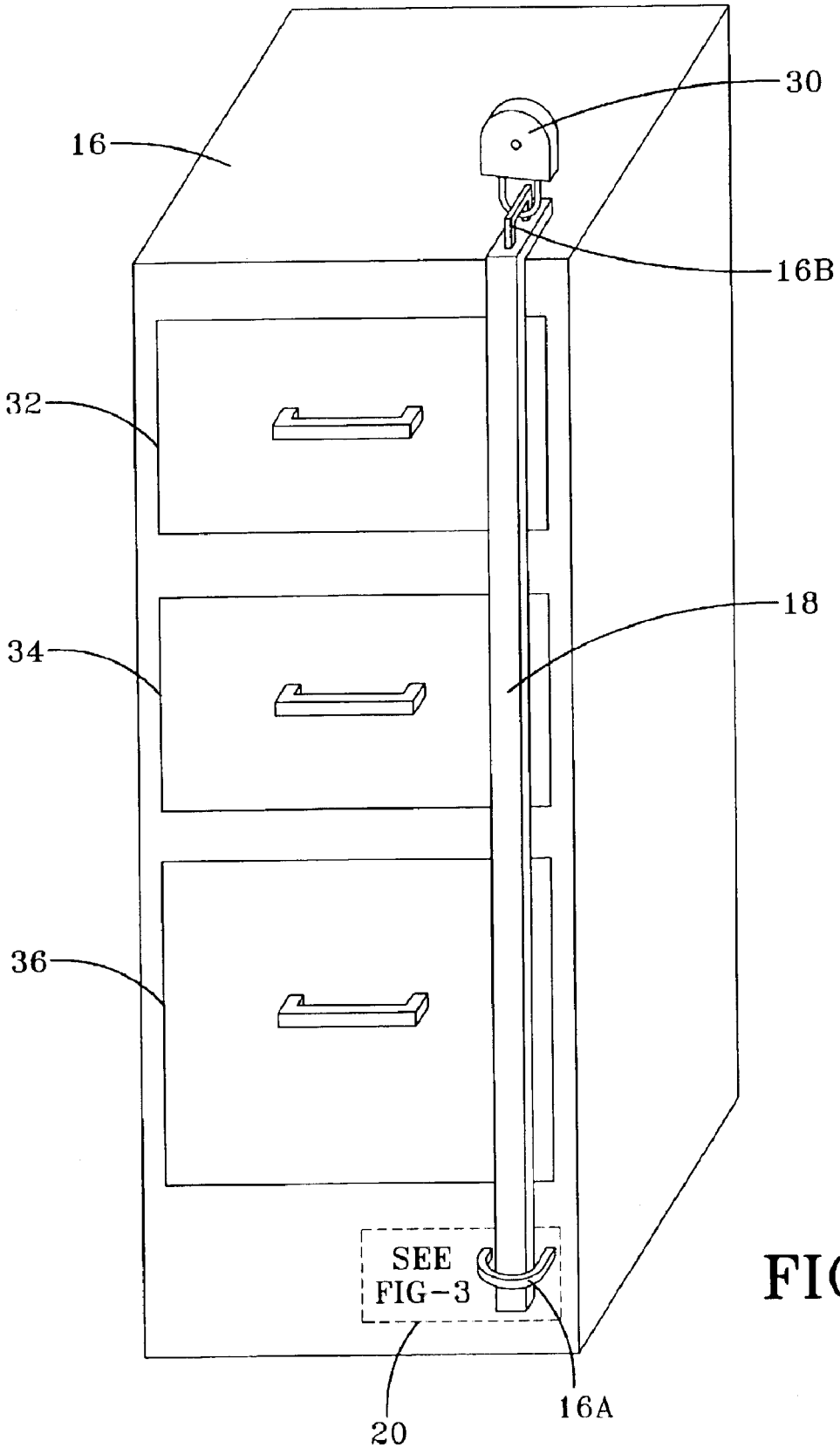
FIG. 2 illustrates a cabinet having a locking bar attached thereto.

FIG. 2 shows one type of cabinet 16 often used for storing classified material having a locking bar 18, which is secured by passing the locking bar 18 through metal brackets 16A and 16B with 16A being below each drawer 32, 34, and 36 and dimensioned to accept and hold the lower portion of the locking bar 18. The top of the bar 18 is inserted through bracket 16B that allows a combination lock 30 to be used to capture and lock the locking bar 18. The interaction of the locking bar 18 with the electronics 20 may be further described with reference to FIG. 3, which illustrates the details of the electronics 20 contained in cabinet 16, as well as one embodiment of a guidance assembly assisting the mating of the locking bar 18 to the cabinet 16 and comprising magnets 40A and 40B.

Figure 3:
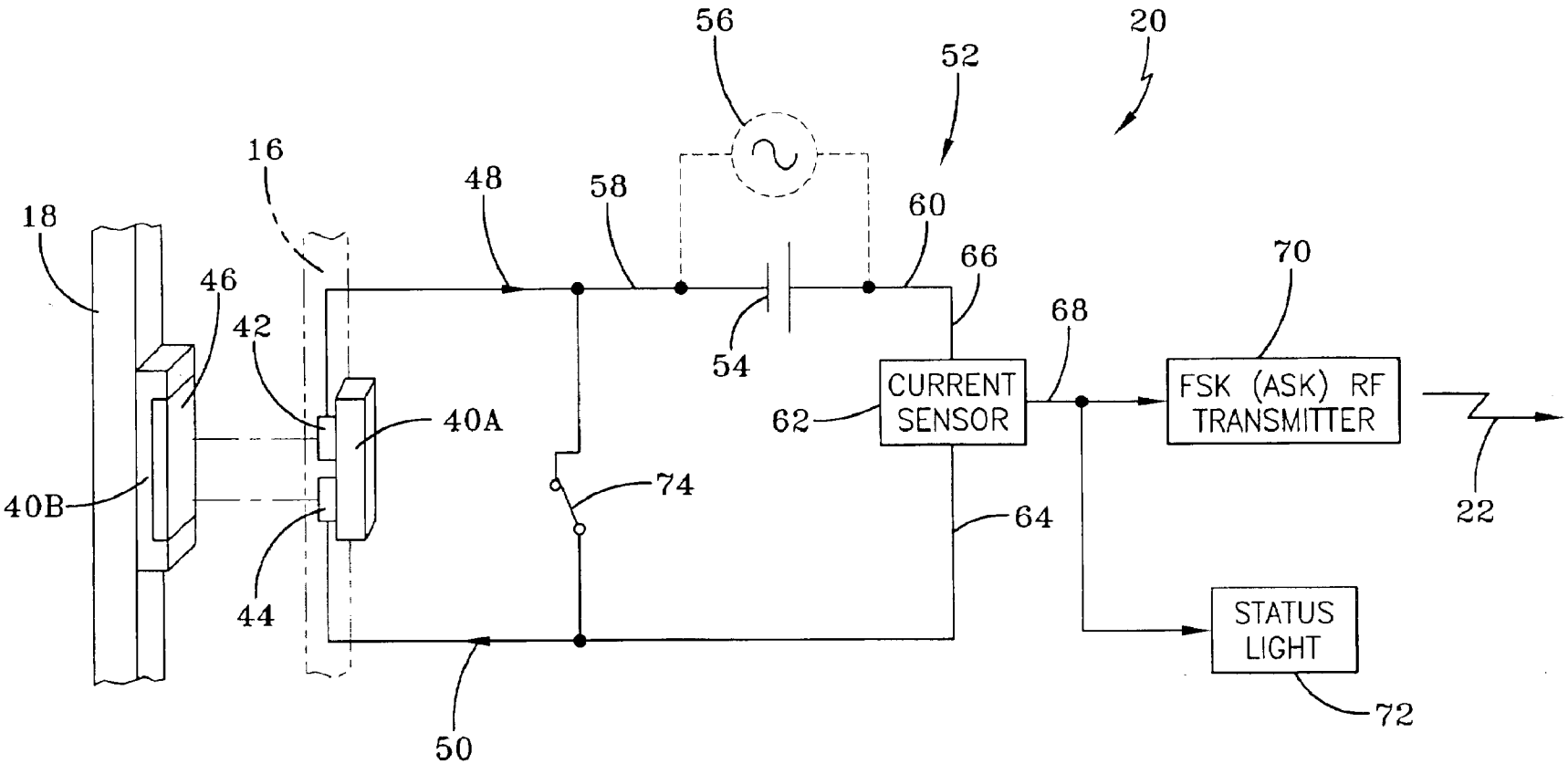
FIG. 3 illustrates a schematic of the electronics housed on a cabinet associated with the present invention.

In general, the magnet 40A is placed on the cabinet 16 with 42 and 44 electrodes attached to the magnet 40A as shown in FIG. 3. The other magnet 40B preferably rests on the surface of the locking bar 18 and has an embedded electrode 46 that makes contact with the other 42 and 44 electrodes when the magnets 40A and 40B meet. If desired, the magnet 40B may be embedded in the locking bar 18. The magnet 40B is positioned adjacent and preferably in contact with the electrode 46 and, similarly, the magnet 40A is positioned adjacent and preferably in contact with the electrodes 42 and 44. When the locking bar 18 is put in place, an electrical connection is made between the 42 and 44 electrodes in the cabinet 16 and the electrode 46 in the locking bar 18, and current flows through the circuit included in the electronics 20, as shown by directional arrows 48 and 50. When the locking bar 18 is removed, the electrical connection between the first, second and third (46, 42 and 44) is broken and the current becomes 0. The presence of current flow, and more particularly the change in current flow, causes the electronics. 20 to generate signal 22 and which is representative that the locking bar 18 has either been attached (presence) or unattached (absence) to the cabinet 6.

More particularly, with reference to FIG. 3, the first electrode 46 is fixed at a predetermined location on the fastener 18 and the second and third electrodes 42 and 44, respectively are located on the cabinet 16 in a predetermined manner, so that when the locking bar 18 is inserted into the brackets 16A and 16B, the first electrode 46 contacts both the second and third electrodes 42 and 44 providing electrical connection therebetween. Conversely, when the locking bar 18 is removed from the cabinet 16 the electrical connection is broken.

Although the magnet 40A, and the bar magnet 40B perform well in assisting the electrical mating of the electrodes 42, 44 and 46, other devices may be used. For example, the desired mating may be accomplished by mechanical means, such as extensions from the locking bar 18 mating with cutouts in the cabinet 16. The primary function is to ensure that the first electrode 46 electrically mates with the electrodes 42 and 44 of the current sensing network 52 shown in FIG. 3 when the locking bar 18 is in place.

The current sensing network 52 comprises a source of electrical energy that may be selected from the group consisting of a DC battery 54 and AC excitation 56, each of which have first and second ends 58 and 60 respectively. The current sensing network 52 further comprises a current sensor 62, as well as the second and third electrodes 42 and 44 that are spaced apart from each other, with the second electrode 42 connected to the first end 58 of the source of electrical excitation. The third electrode 44 is connected to a second end 64 of the current sensor 62, which has its first end 66 connected to second end 60 of the source of electrical energy. The current sensor 62 has an output 68 connected to the input of a transmitter 70.

The current sensor 62 operates in a manner known in the art and upon detection of a change in current flow, generates output signal on signal path 68. The output signal on signal path 68 may also activate a status light 72. The electronics 20 may further comprise test 74, which is connected across the electrodes 42 and 44, as shown in FIG. 3. The test switch 74, when depressed, causes current flow which is sensed by current sensor 62 which, in turn, generates an output signal on signal path 68 which, in turn, causes the transmitter 70 to generate the output signal 22.

The transmitter 70 generates a predetermined signal of a selected communication link upon the detection of current flow. The predetermined signal is preferably a radio frequency (RF) signal and the communication link may be selected from the group consisting of a frequency shift key (FSK) technique and an amplitude shift key (ASK) technique.

In one embodiment, an FSK sequence of pulses is transmitted by transmitter 70 whenever the current sensor 62 senses a change in the magnitude of the current, such as DC current going from 0 to a positive (+) quantity, or conversely when the DC current goes from a positive (+) quantity to 0. When the current sensor 62 detects a change in the current's magnitude, the RF transmitter 70 is activated and the FSK pulse stream commences. A short sequence of pulses (10 pulses per sequence), each having a duration of 10 milliseconds in one embodiment, provides a high degree of reliability in the receiver 24 detection capability, to be further described hereinafter with reference to FIG. 4. An alerting device 88 of FIG. 4 (also to be further described with reference to FIG. 4) at the centralized status monitor receiver 24 associated with each cabinet $\mathbf{16}_1 \ldots \mathbf{16}_N$ is initialized at installation to the OFF state when the locking bar 18 is put in place for the first time at its respective cabinet 16. After installation, the alerting device 88 will remain OFF until a sequence of pulses is received, indicating that the cabinet $\mathbf{16}_1 \ldots \mathbf{16}_N$ has been opened; then, the alerting device 88 will be activated to the ON state. Thereafter, the alerting device 88 state will change each time a pulse sequence, in the form of signal 22, is transmitted by transmitter 70 and received by receiver 24.

A FSK pulse sequence will be transmitted when the locking bar 18 is either removed or put in place and the electrical connection between electrodes 42, 44 and 46 is either broken or established. A bit switch device, which may be part of each transmitter 70, enables one to set the cabinet identification number (e g., 001). More particularly, the transmitter 70 installed in cabinet $\mathbf{16}_1$, may be enabled to transmit the binary code 001, whereas the transmitter 70 installed in cabinet $\mathbf{16}_8$ may be enabled to transmit the binary code 111. The receiver 24, as well as the alerting device 88, may be further described with reference to FIG. 4.

Figure 4A:
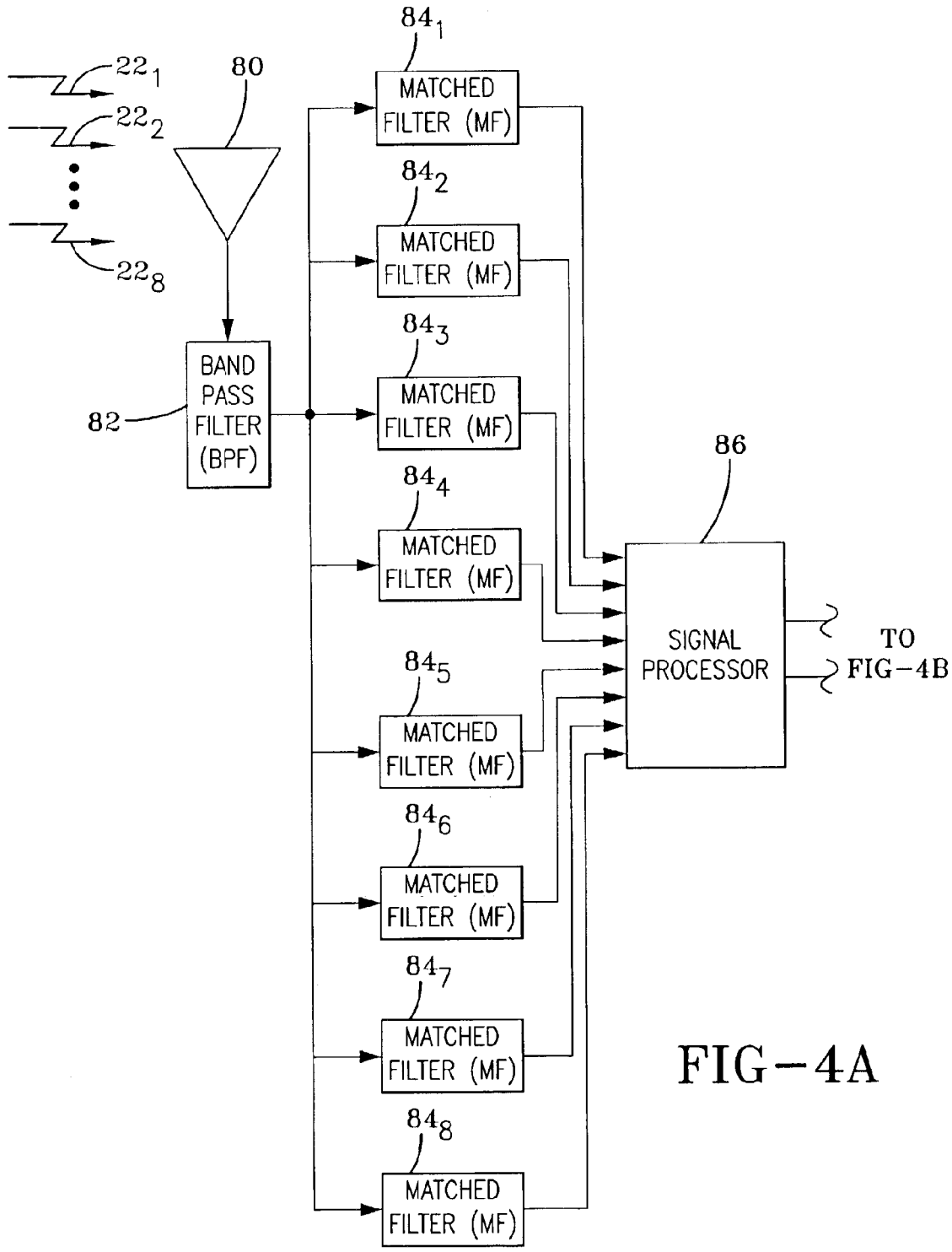
FIG. 4 is a block diagram of the receiver of the electronic status monitoring system of the present invention.
Figure 4B:
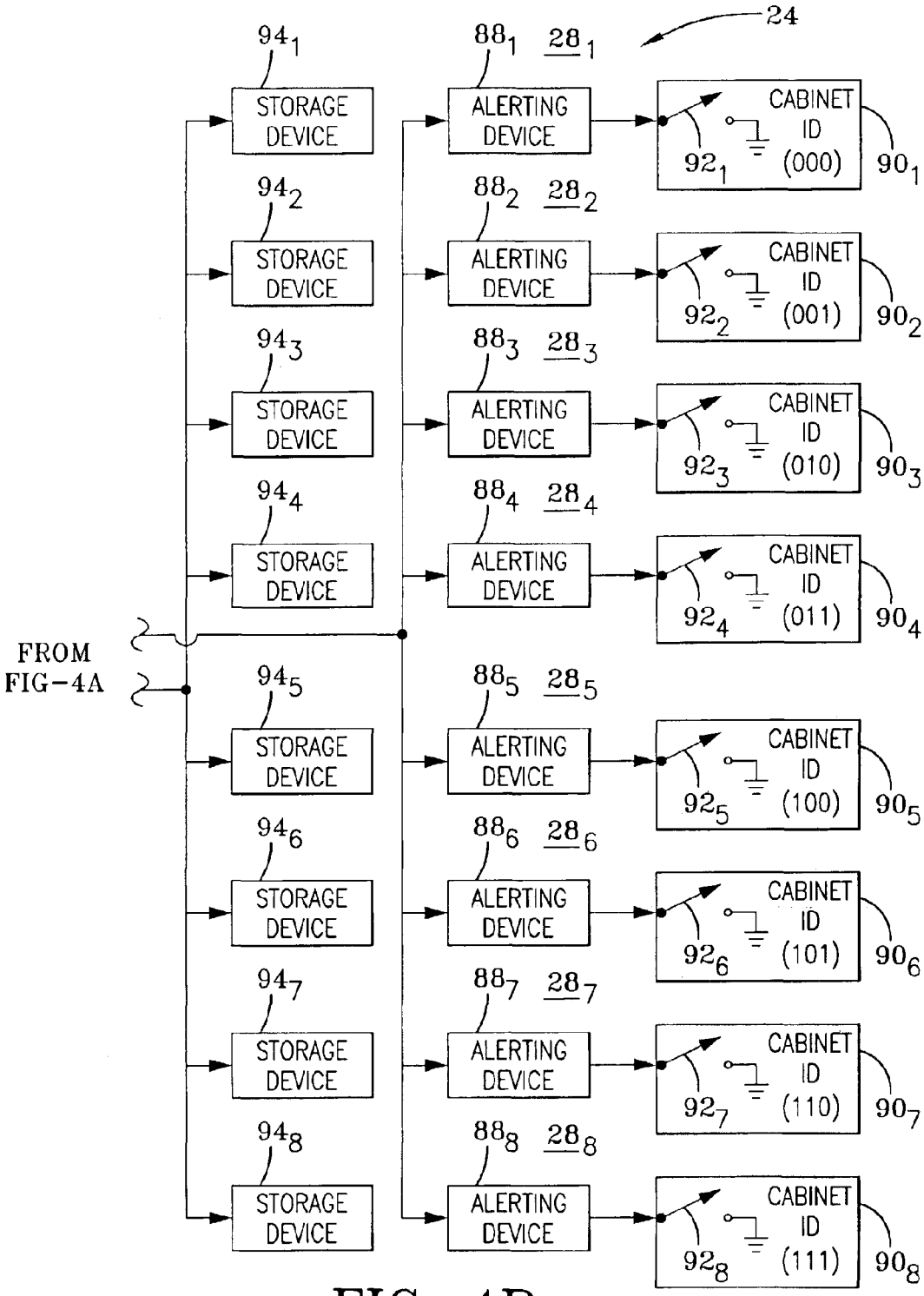

The receiver 24 is shown in FIG. 4, which illustrates an arrangement for handling cabinets $\mathbf{16}_1 \ldots \mathbf{16}_8$ where each respective transmitter 70 transmits an output signal $\mathbf{22}_1$, $\mathbf{22}_2 \ldots \mathbf{22}_8$. The receiver 24 comprises an antenna 80, which receives all the different signals from all the transmitters and provides a respective output thereof. The receiver 24 further comprises a band pass filter 82 that is selected to receive and pass all of the predetermined signals $\mathbf{22}_1 \ldots \mathbf{22}_8$ that are within the selected band of frequencies of interest. The band pass filter 82 provides a respective output for each of its received signals.

The receiver 24 further comprises matched filters $\mathbf{84}_1$, $\mathbf{84}_2$, $\mathbf{84}_3$, $\mathbf{84}_4$, $\mathbf{84}_5$, $\mathbf{84}_6$, $\mathbf{84}_7$, and $\mathbf{84}_8$. Each of the filters $\mathbf{84}_1 \ldots \mathbf{84}_8$ is connected to the output of the band pass filter 82 and each is separately selected to receive and pass a particular wave form comprising an output signal and corresponding to a respective transmitter. For example, matched filter $\mathbf{84}_1$ is selected to pass the waveform that is particular to the transmitter 70 contained in the electronics 20 of cabinet $\mathbf{16}_1$. Each output of the match filter $\mathbf{84}_1 \ldots \mathbf{84}_8$ is routed to a signal processor 86, which provides respective output signals representative of the presence and absence of the fastener 18 being secured to its respective cabinet 16. More particularly, for example, if the signal processor 86 receives a signal from the matched filter $\mathbf{84}_1$ that received signal represents a current change has been sensed by the current sensor 62 in cabinet $\mathbf{16}_1$, which, in turn, represents that the locking bar $\mathbf{18}_1$, has either been removed (absence) from cabinet $\mathbf{16}_1$, or installed (presence) on cabinet $\mathbf{16}_1$. The receiver 24 further comprises the cabinet status devices $\mathbf{28}_1 \ldots \mathbf{28}_8$, previously discussed with reference to FIG. 1 and each of which comprise an alerting device 88 and a cabinet identification (ID) 90, each having a switch 92 and wherein the cabinet ID 90 displays the associated binary code, e g., 000 for cabinet $\mathbf{16}_1$. Each of the cabinets $\mathbf{16}_1 \ldots \mathbf{16}_8$ further preferably are respectively provided with a storage device $\mathbf{94}_1 \ldots \mathbf{94}_8$, which tracks the number of pulses received.

The arrangement shown in FIG. 4 is associated with a conventional matched filter detector $\mathbf{84}_1 \ldots \mathbf{84}_8$ for eight (8) possible FSK signals (1 per cabinet), a storage device 94 , which tracks and records the number of detection's in response to the signal processor 86, and an alerting device 88 showing the status of each cabinet 16 locking bar 18.

In this embodiment, the storage device 94 changes state when 5 out of 10 pulses are detected. At installation, the unique container identifier and FSK frequency sequence is set by using the digital bit set mechanism shown in FIG. 4, that is, if the locking bar 18 is in place the associated switch 92 is closed. More particularly, for example, if locking bar $\mathbf{18}_1$ is in place, then switch $\mathbf{92}_1$ is closed and the cabinet ID $\mathbf{90}_1$ is energized indicated by binary code (000). This mechanism sets the specific FSK frequency sequence unique to that cabinet. In one configuration, the code is as follows: f1 represents 0 and f2 represents 1. Cabinet $\mathbf{16}_1$, more particularly its transmitter 70, identified as 000 would generate an FSK sequence f1, f1, f1; cabinet $\mathbf{16}_2$, more particularly its transmitter 70, identified as 001 would generate an FSK sequence f1, f1, f2; and cabinet $\mathbf{16}_8$, more particularly its transmitter 70, identified as 111 would generate an FSK sequence f2, f2, f2.

In another embodiment, the FSK RF signal is replaced by an ASK (amplitude shift key) signal. The number of FSK pulses or ASK pulse per sequence may vary. The detection scheme, which was 5 out of 10 in our example, may be redefined all done in a manner known in the art.

It should now be appreciated that the practice of the present invention provides for an electronic monitoring system that allows a fastener, such as a locking bar 18 to be used in an arrangement comprising of a large number of cabinets. The monitoring system 10 enables the security person to obtain information about the status of each cabinet 16. The electronic monitoring system 10 of the present invention can be implemented at one location using a computer to display the status of each container which, yields the benefits of saving time and effort commonly expended by security persons in a military or commercial complex.

It will be understood that various changes and details, steps and arrangement of parts and method steps, which have been described and illustrated in order to explain the nature of the invention, may be made by those skilled in the art within the principle and scope of the invention as expressed in the appended claims.

What is claimed is:

1. An electronic monitor for detecting the presence and absence of a locking bar that mates with a cabinet with the presence thereof preventing the opening of one or more drawers being housed by said cabinet, said electronic monitor comprising:

a first electrode fixed at a predetermined location on said locking bar;

current sensing network comprising;

source of electrical excitation having first and second ends;

current sensor having first and second ends and generating an output upon detecting current flow with the first end thereof connected to said second end of said source of electrical excitation;

second and third electrodes spaced apart from each other with the second electrode connected to said first end of said source of electrical excitation and said third electrode connected to said second end of said current sensor, said second electrode and third electrode being located in a predetermined manner so as to come into contact with said first electrode when said locking bar mates with said cabinet; and a transmitter connected to said output of said current sensor and generating a predetermined signal of a selected communication link upon said detection of a change in said current flow.

2. The electronic monitor according to claim 1 further comprising a guiding assembly for assisting alignment of said second and third electrodes with said first electrode when said locking bar mates with said cabinet.

3. The electronic monitor according to claim 2, said guiding assembly comprising:

a first magnetic assembly positioned on said locking bar positioned adjacent said first electrode; and a second magnetic assembly positioned on said cabinet positioned adjacent said second and third electrodes.

4. The electronic monitor according to claim 1 wherein said predetermined signal is a Radio Frequency (RF) signal.

5. The electronic monitor according to claim 1 wherein said communication link is selected from the group consisting of a Frequency Shift Key (FSK) technique and an Amplitude Shift Key (ASK) technique.

6. The electronic monitor according to claim 1 wherein said predetermined signal comprises a series of RF pulses and, wherein at least ten (10) RF pulses occur within duration of about 200 milliseconds.

7. The electronic monitor according to claim 1 further comprising a test switch connected across said second and third electrodes.

8. An electronic monitoring system for detecting and displaying at a central location the presence and absence of one or more fasteners that respectively secure one or more cabinets with the presence thereof preventing the opening of one or more drawers being housed in each of the one or more cabinets, said electronic monitoring system comprising;

first electrode fixed at a predetermined location in each of said respective fasteners;

a current sensing network for each of said one or more cabinets and having second and third electrodes located in a respective cabinet in a predetermined manner so that said first electrode of a respective fastener contacts both said second and third electrodes of its respective cabinet when said respective fastener secures said respective cabinet, said current sensing network generating an output signal upon sensing a change in current flow;

a transmitter located in each of said cabinets and connected to said output of a respective current sensing network and generating a predetermined signal of a selected communication link upon detection of said change in said current flow, each of said transmitters generating predetermined signals that are different from each of said transmitters; and a receiver located at said central location and accepting and recognizing all of said different predetermined signals of all of said transmitters and generating respective output signals representative of said presence and absence of respective fasteners being attached to respective cabinets.

9. The electronic monitoring system according to claim 8 wherein said predetermined signals are Radio Frequency (RF) signals.

10. The electronic monitoring system according to claim 9 wherein said communication link is selected from the group consisting of a Frequency Shift Key (FSK) technique and an Amplitude Shift Key (ASK) technique.

11. The electronic monitor system according to claim 8 further comprising a test switch connected across said second and third electrodes.

12. The electronic monitoring system according to claim 8 wherein all of said predetermined signals of all of said transmitters are within a band of frequencies and each of said transmitters generates a particular wave form different from each other and wherein said receiver comprises:

an antenna receiving all of said different signals from all of said transmitters and providing a respective output thereof;

a band pass filter selected to receive and pass all of said predetermined signals within said band of frequencies, said band pass filter providing a representative output thereof;

one or more matched filters each connected to said output of said band pass filter and each separately selected to receive and pass a particular waveform comprising an output signal and corresponding to a respective transmitter; and a signal processor connected to receive each of said output signals of each of said one or more matched filters and providing a respective output signal representative of the presence and absence of said fastener being secured to a respective cabinet.

13. The electronic monitoring system according to claim 12 further comprising indicator devices respectively connected to receive each of said representative output of said signal processor.

14. The electronic monitoring system according to claim 13 wherein said processor counts output signals of each of said matched filters and wherein said electronic monitoring system further includes a storage device associated with a respective matched filter and wherein said processor stores the counted output signals of respective matched filters.

15. A method for providing electronic monitoring for detecting at a central location the presence and absence of one or more fasteners that respectively secure one or more cabinets with the presence thereof preventing the opening of one or more drawers being housed in each of the one or more cabinets, said method comprising the steps of:

providing a first electrode fixed at a predetermined location in each of said respective fasteners;

providing a current sensing network for each of said one or more cabinets and having second and third electrodes and generating a current flow when said first, second and third electrodes are in contact, said current sensing network generating an output signal upon sensing a change in said current flow;

locating said second and third electrodes on each respective cabinet in a predetermined manner so that said first electrode of a respective fastener contacts both said second and third electrodes of its respective cabinet when said respective fastener secures respective cabinet;

providing a transmitter located on each of said cabinets and connected to said output of respective current sensing network and which generates predetermined signals of a selected communication link upon detection of said output of said current sensing network, each of said transmitters generating predetermined signals that are different from each of said transmitters; and providing a receiver located at said central location that accepts and recognizes all of said different predetermined signals of all of said transmitters and generates respective output signals representative of said presence and absence of respective fasteners.

16. The method according to claim 15 wherein said communication link is selected from the group consisting of a Frequency Shift Key (FSK) technique and an Amplitude Shift Key (ASK) technique.

17. The method according to claim 16 wherein said predetermined signal comprises a series of RF pulses and, wherein said RF pulses occur within a predetermined duration.

18. The method according to claim 17 wherein at least ten (10) RF pulses occur within duration of about 200 milliseconds.

19. The method according to claim 16 wherein said RF pulses represent a binary code.

20. The method according to claim 15 further comprises providing a test switch connected across said second and third electrodes.

* * * * *